US007235116B2

(12) United States Patent
Rodrigues et al.

(10) Patent No.: US 7,235,116 B2
(45) Date of Patent: Jun. 26, 2007

(54) HIGH TEMPERATURE CORROSION AND OXIDATION RESISTANT VALVE GUIDE FOR ENGINE APPLICATION

(75) Inventors: Heron A. Rodrigues, Charlotte, NC (US); Sundaram L. Narasimhan, Marshall, MI (US); Sinharoy Shubhayu, Kalamazoo, MI (US); Kevin J. Martus, Ceresco, MI (US)

(73) Assignee: Eaton Corporation, Cleveland, OH (US)

( * ) Notice: Subject to any disclaimer, the term of this patent is extended or adjusted under 35 U.S.C. 154(b) by 393 days.

(21) Appl. No.: 10/447,580

(22) Filed: May 29, 2003

(65) Prior Publication Data

US 2004/0237715 A1 Dec. 2, 2004

(51) Int. Cl.
*C22C 33/02* (2006.01)

(52) U.S. Cl. ..... 75/246

(58) Field of Classification Search ..... 75/243, 75/246

See application file for complete search history.

(56) References Cited

U.S. PATENT DOCUMENTS

| | | | | |
|---|---|---|---|---|
| 3,856,478 | A | 12/1974 | Iwata et al. | 29/782 |
| 4,021,205 | A * | 5/1977 | Matsuda et al. | 75/246 |
| 4,035,159 | A * | 7/1977 | Hashimoto et al. | 75/246 |
| 4,121,927 | A | 10/1978 | Lohman et al. | 75/201 |
| 4,648,903 | A | 3/1987 | Ikenoue et al. | 75/230 |
| 4,836,848 | A | 6/1989 | Mayama et al. | 75/231 |
| 5,221,321 | A | 6/1993 | Lim | 75/246 |
| 5,312,475 | A | 5/1994 | Purnell et al. | 75/231 |
| 5,482,637 | A | 1/1996 | Rao et al. | 252/29 |
| 5,649,994 | A | 7/1997 | Holko | 75/255 |
| 5,674,449 | A | 10/1997 | Liang et al. | 420/12 |
| 5,679,909 | A | 10/1997 | Kaneko et al. | 75/246 |
| 5,759,227 | A | 6/1998 | Takahashi et al. | 75/246 |
| 5,808,214 | A * | 9/1998 | Kaneko et al. | 75/246 |
| 5,934,238 | A | 8/1999 | Wang et al. | 123/188.3 |
| 5,960,760 | A | 10/1999 | Wang et al. | 123/188.3 |
| 6,102,016 | A | 8/2000 | Sitar et al. | 123/568.23 |
| 6,139,598 | A | 10/2000 | Narasimhan et al. | 75/246 |
| 6,200,688 | B1 | 3/2001 | Liang et al. | 428/544 |
| 6,214,080 | B1 | 4/2001 | Narasimhan et al. | 72/255 |
| 6,216,677 | B1 | 4/2001 | McConnell et al. | 123/568.24 |
| 6,305,666 | B1 * | 10/2001 | Sakai | 251/368 |
| 6,599,345 | B2 | 7/2003 | Wang et al. | 75/231 |
| 2003/0110888 | A1 * | 6/2003 | Kosco | 75/255 |

FOREIGN PATENT DOCUMENTS

| | | |
|---|---|---|
| EP | 0266935 | 5/1988 |
| EP | 0406452 | 6/1989 |
| EP | 0392484 | 4/1990 |
| EP | 0481763 | 10/1991 |
| EP | 0621347 | 4/1994 |
| EP | 1 172 452 A2 | 6/2000 |
| JP | 6-346180 | 12/1994 |

OTHER PUBLICATIONS

U.S. Appl. No. 10/183,289, filed Jun. 27, 2002, entitled Powder Metal Valve Seat Insert—Pending Valve Gear Wear and Materials, 851497, S. L. Narasimhan and J. M. Larson Wear, the Effect of Operating Conditions on Heavy Duty Engine Vale Seat Wear Y. S. Wang, S. Narasimhan, J. M. Larson, and G. C. Barber, Wear 201 (1996) 15-25.

Sintered Valve Seat Inserts and Valve Guides: Factors Affecting Design, Performance & Machinabillity, H. Rodrigues, Admitted Prior Art.

* cited by examiner

*Primary Examiner*—Ngoclan T. Mai
(74) *Attorney, Agent, or Firm*—Daniel S. Kalka

(57) ABSTRACT

A powder metal component particularly suited for use as a valve guide in high temperature applications. The powder metal component according to a first embodiment has a chemical composition on a weight percent basis of about 0.1-2.0% C; about 8.0-18.0% Cr; about 1.0-15.0% Mo; about 0.1-3.5% S; about 0.1%-2.0% Si; upto about 5.0% max other elements; and the balance being substantially Fe. A second embodiment according to the present invention includes about 8.0-16.0% Co.

18 Claims, 4 Drawing Sheets

HIGH TEMPERATURE CORROSION AND OXIDATION RESISTANT VALVE GUIDE FOR ENGINE APPLICATION

BACKGROUND OF THE INVENTION

1. Field of the Invention

The present invention relates in general to powder metal engine components, and more particularly to a new and improved powder metal valve guide for high temperature applications.

2. Description of the Related Art

Valve guides are typically tubular structures constructed to receive the valve stem of an engine poppet valve in an internal combustion engine. The construction of these engine components is well known to those skilled in this art.

Powder metal (P/M) valve guides are made from relatively low alloy steels containing ferritic/pearlitic microstructures with solid lubricants such as silicates, free graphite, manganese sulfide, copper sulfide or molybdenum disulfide. The prior art P/M valve guide is pressed to a low to medium density, sintered using conventional sintering temperatures, such as less than about 1,150° C., and then machined at both ends. The inner bore is formed by reaming. It is known in the art to oil impregnate the valve guides for extending their life. The operation of the internal combustion engine replenishes the valve guides with oil. The life expectancy of the valve guides relies on the engine oil to lubricate the interface between the valve stem and the valve guide. Recently, there have been efforts to design what may be termed as "oil starved" valve guides to address the problem of air pollution caused by engine lubricant oil leaking into the combustion chamber through the valve stem and valve guide interface.

U.S. patent application Ser. No. 09/969,716, filed Oct. 2, 2001 by the Assignee of the present invention, which is hereby incorporated by reference herein, is directed to such a valve guide capable of withstanding high temperatures with little or no lubrication. The valve guide according to that invention was particularly intended for use in a cooled cylinder block of an internal combustion engine.

Other applications for a valve guide can include locations where the valve guide is exposed to high temperatures such as in excess of about 1000° F. in a system that is not cooled. For example, an exhaust gas recirculation (EGR) valve is disposed between an engine exhaust manifold and the engine intake manifold. The EGR valve uses a poppet valve (which includes a valve guide) to permit the recirculation of exhaust gas from the exhaust side of the engine back to the intake side. As is known to those skilled in the art, such recirculation of exhaust gasses is helpful in reducing various engine emissions.

It has become desirable to operate the EGR valve in a continuously variable mode responsive to control signals from the engine control unit (ECU) for optimum engine performance while simultaneously minimizing emissions. As a result, the poppet valve and valve guide in the EGR valve are exposed continuously to the high temperatures and corrosive properties of the exhaust gas for prolonged periods of time.

The excessive temperature can negatively affect the performance of the components, and particularly the performance of the reciprocal movement of the valve stem within the valve guide such as, for example, the valve sticking or seizing within the valve guide. The corrosive materials found in the exhaust stream further negatively impact the life of the components.

Thus, there still exists a need for a powder metal valve guide capable of withstanding the significantly high temperatures found in EGR valve applications as well as being useful in other high temperature applications where the valve guide is provided with little or no lubrication, or cooling.

BRIEF SUMMARY OF THE INVENTION

Accordingly, an object of the present invention is to provide an improved powder metal engine component capable of withstanding high temperatures and a corrosive environment.

Another object of the present invention is to provide an improved powder metal valve guide for high temperature applications with little or no cooling.

Still another object of the present invention is to provide a powder metal valve guide suitable for use in EGR valve applications.

The above and other objects of the present invention are accomplished by the provision of a powder metal engine component having a chemical composition on a weight percent basis comprising about 0.1 to about 2.0% carbon; about 8.0 to about 18.0% chromium; about 1.0 to about 15.0% molybdenum; about 0.1 to about 3.5% sulfur; about 0.1% to about 2.0% silicon; upto about 5.0% maximum (max) other element; and the balance being substantially iron.

In addition, the objects of the present invention are further accomplished by the provision of a cobalt based powder metal engine component having a chemical composition on a weight percent basis, comprising about 0.1 to about 2.0% carbon; about 8.0 to about 18.0% chromium; about 1.0 to about 15.0% molybdenum; about 0.1 to about 3.5% sulfur; about 8.0 to about 16.0% cobalt; about 0.1 to about 2.0% silicon; upto about 5.0% max other elements; and the balance being substantially iron.

The various features of novelty which characterize the invention are pointed out with particularity in the claims annexed to and forming a part of this disclosure. For a better understanding of the invention, its operating advantages, and specific objects attained by its uses, reference is made to the accompanying examples, drawings, and descriptive matter in which preferred embodiments of the invention are illustrated.

DETAILED DESCRIPTION OF THE INVENTION

Figure 1:
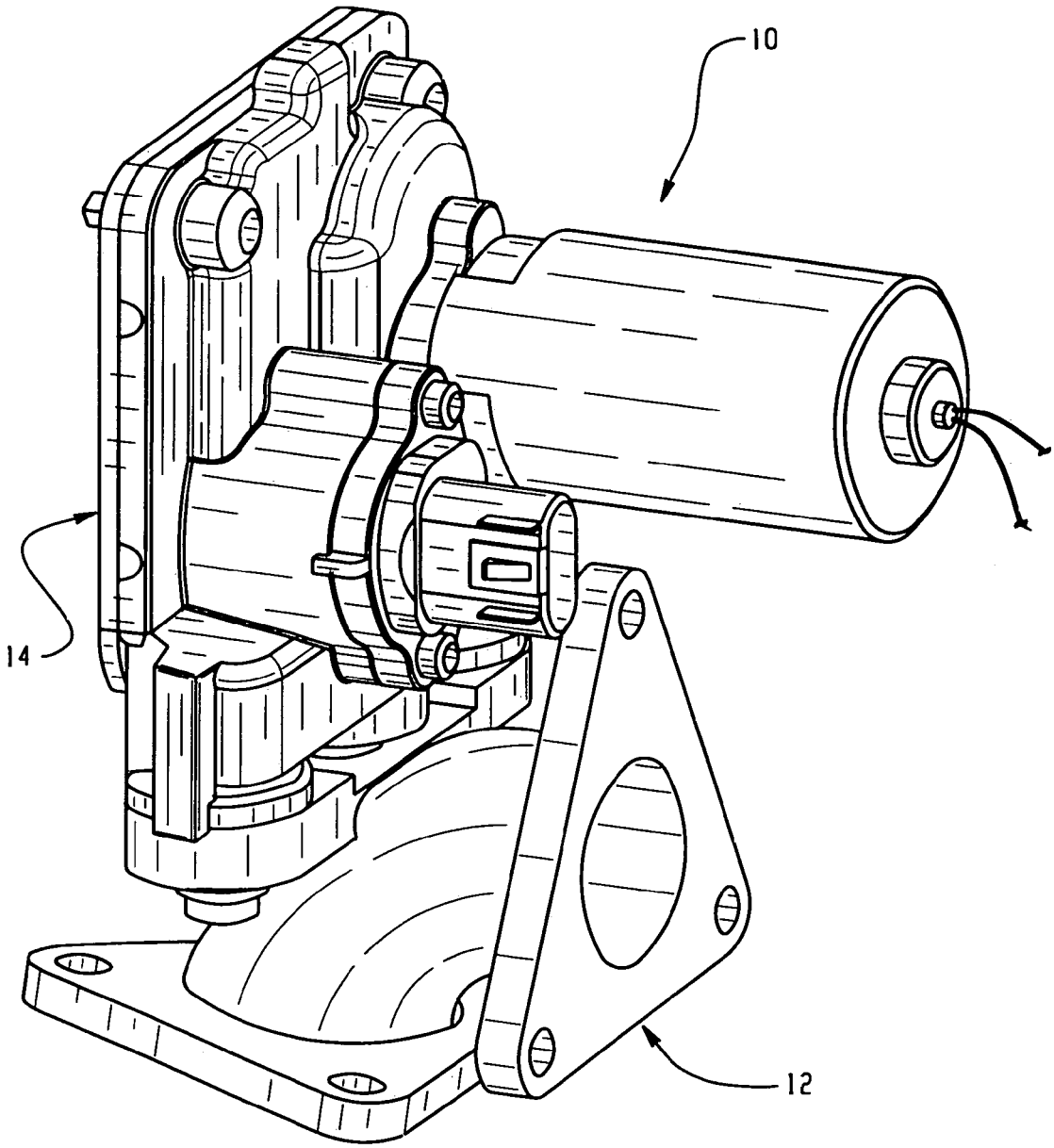
FIG. 1 is a generally rearward, perspective view of an EGR system and actuator assembly.

Referring now to the drawings, which are not intended to limit the invention, FIG. 1 illustrates an exhaust gas recirculation (EGR) system generally designated 10. The EGR system 10 is a device known in the art and is described in U.S. Pat. No. 6,102,016 which is assigned to the Assignee of the present invention, and is hereby incorporated by reference. It should be understood that the present invention can find utility in any high temperature application, including but not limited to application as an engine component in an internal combustion engine.

Although the use of the present invention as a valve guide or a powder metal engine component is not limited to any particular type of engine or an engine system, such as the EGR system, the use of the present invention is especially advantageous in connection with an EGR system which employs a poppet valve and a valve guide as will be described herein briefly for reasons which will become apparent subsequently. It should be immediately apparent that EGR system 10 is being shown and described herein only by way of example, and the present invention is not intended to be limited only to this type of system.

Figure 2:
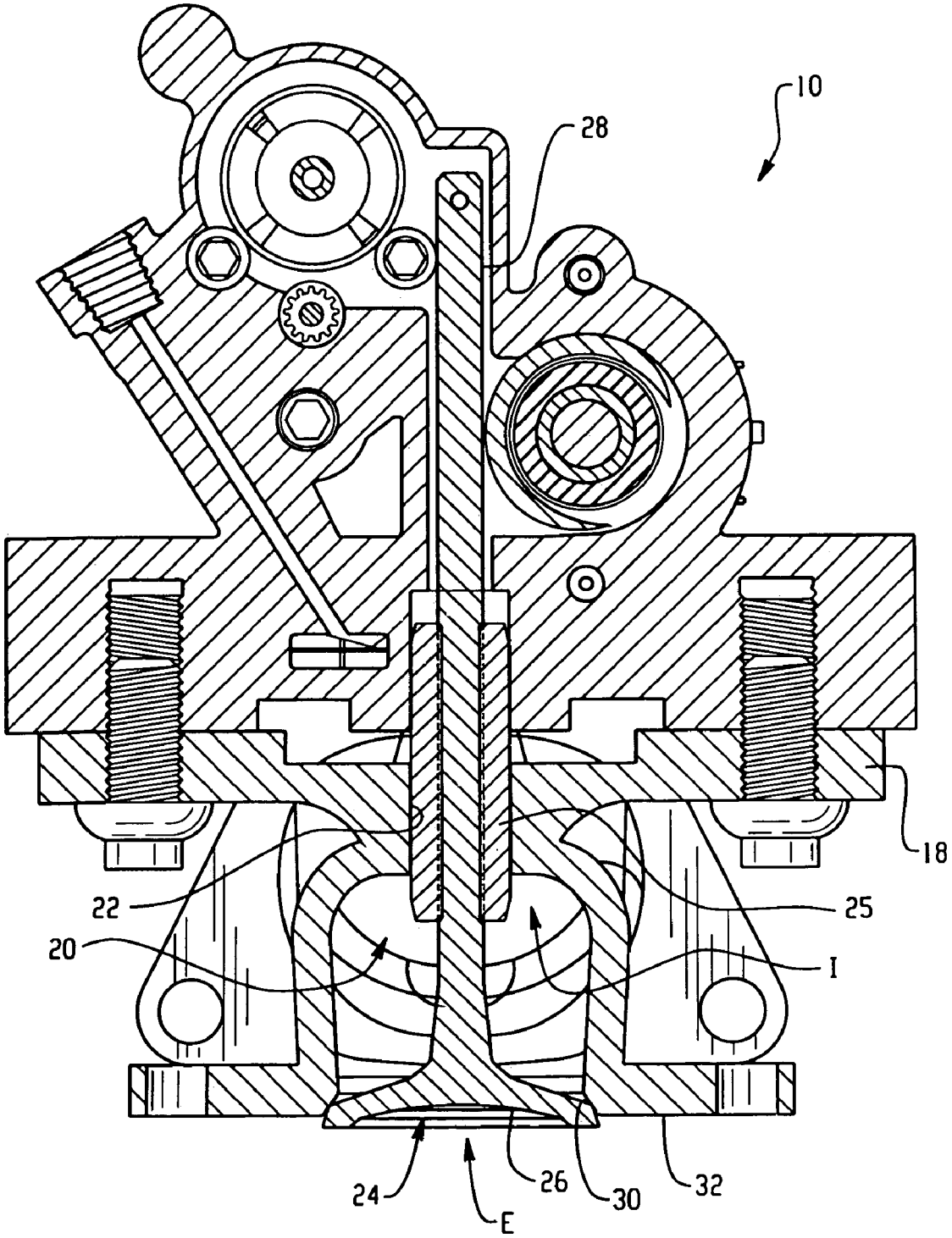
FIG. 2 is an axial, vertical cross-section viewed from the front of the EGR system and actuator assembly shown in FIG. 1.

The EGR system 10 includes a plurality of sections including a manifold portion 12 and an actuator portion 14. As shown in FIG. 2, the manifold portion 12 comprises a manifold housing 18 defining a passage 20 and a bore 22 within which a valve member, generally designated 24, is reciprocally supported for axial movement therein within a valve guide 25. The valve member 24 includes a poppet valve portion 26 formed integrally with a valve stem 28.

The manifold housing 18 further defines a valve seat 30 against which the poppet valve portion 26 seats when the valve member 24 is closed, such that the valve seat 30 serves as the "close stop". Although the poppet valve portion 26 is shown spaced slightly apart from the valve seat 30, for clarity of illustration, what is shown in FIG. 2 will be referred to as representative of the closed position of the valve member 24. By way of example only, the manifold housing 18 includes a flange 32 for connection to an exhaust manifold (not shown herein) such that the region below the poppet valve portion 26 in FIG. 2 comprises an exhaust gas passage E. For a more detailed description on the operation and structure of the EGR system 10, reference may be made to the above-incorporated U.S. Pat. No. 6,102,016. The foregoing description of the EGR system is merely being provided to facilitate a better understanding and use for the novel material of the present invention.

As is well known to those skilled in the art, the contact of the manifold housing 18 with hot exhaust gasses, flowing from exhaust gas passage (E) to an intake passage (I) will result in the manifold housing 18 becoming quite hot, for example, in excess of 1000° F. As a result, the valve member 24 and valve guide 25 are continuously exposed to high temperatures and the corrosive environment of the exhaust gas.

The valve guide material of valve guide 25 must be capable of surviving this harsh engine environment to resist the oxidation and/or corrosion that occurs on the internal diameter (ID) surface. Otherwise, scuffing, sticking or even seizing of the valve stem 28 can occur.

The present invention resides in a novel material that has a microstructure comprising an intermetallic Laves phase in a soft stainless steel matrix, solid lubricant, and pore volume and morphology that are capable of functioning as reservoirs for impregnating oils.

In the specification, unless otherwise specified, all percentages are on a weight percent basis. Powder metallurgy processes can offer a cost-effective, near-net shape production, but yet allow versatility in material selection and post-sintering treatments. The novel material of the present invention offers superior properties of abrasive and adhesive wear resistance, scuffing resistance, and can run against various types of valve stems and stem coatings including chrome plated and nitrided stems.

According to a first embodiment of the present invention, a powder metal blend comprising a mixture of a hard phase intermetallic material, graphite, a solid lubricant, a fugitive lubricant, and a stainless steel material are blended together to form a powder metal component.

The hard phase intermetallic material is preferably a T-10 iron Tribaloy material of the type available from North American Hoganas and comprises from about 5% to about 50% of the powder metal blend. Preferably, the T-10 comprises about 7.0% of the blend.

Graphite comprises from about 0.1% to about 2.0% of the blend, and is preferably about 0.5% of the blend. Preferably the graphite is a type SW 1651 graphite which is available from Asburry Graphite. Other grades of graphite either natural or synthetic may be used.

The solid lubricant comprises from about 0.2% to about 8.0% of the blend, and preferably comprises about 2.5% of the blend. The preferred solid lubricant is MoS2, molybdenum disulfide. Other suitable solid lubricants include but are not limited to tungsten disulfide ($WS_2$), boron nitride (BN), talc, calcium fluoride ($CaF_2$) or combinations thereof.

The fugitive lubricant comprises from about 0.2% to about 1.5% of the blend and preferably comprises about 0.6% of the blend. The powdered lubricant is referred to herein as a temporary or fugitive lubricant since it burns off or pyrolyzes during the sintering step. The preferred fugitive lubricant is Kenolube material a brand of lubricant available from North American Hoganas and is a lubricant which is a mixture of zinc stearate and ethylene stearamide. Other suitable fugitive lubricants include but are not limited to zinc stearates, ethylene stearamide, or Acrawax C which is available from Glyco Chemical Company.

Preferably, the stainless steel (ss) material is a 434L stainless steel material which is commercially available from North American Hoganas, and comprises the balance of the blend. Other 400 series stainless steel materials, including but not limited to 409, 410, and 430, or 300 series stainless steels, including but not limited to 303, 304, or 316, may be employed. These are all commercially available materials.

The preferred powder metal blend according to the first embodiment of the present invention comprises approximately 87% 434 ss material, about 7% T-10 material, about 0.5% graphite, about 2.5% $MoS_2$, and about 0.6% Kenolube.

The powder metal blend is thoroughly mixed, for example, in a double cone blender for approximately thirty to sixty minutes, and preferably for thirty minutes to achieve a homogeneous mixture, and then compacted in a die of a desired shape. The compacting is performed at a compacting pressure ranging from about 40 TSI (tons per square inch) to about 65 TSI, and preferably at about 50 TSI until the green compact has a minimum density of 6.0 g/cm$^3$ with a preferred density of 6.2 g/cm$^3$. More preferably, the density ranges from about 6.3 to about 6.7 g/cm$^3$. The compaction can be performed either uniaxially or isostatically.

The green compact is then sintered in a conventional mesh belt sintering furnace at a sintering temperature ranging from about 2050° F. to about 2150° F. in a nitrogen/hydrogen ($N_2/H_2$) atmosphere for approximately twenty minutes minimum. More preferably, the sintering temperature is approximately 2100° F. for about thirty minutes in an atmosphere of approximately (on a volume basis) 75% $H_2$/25% $N_2$. The sintering temperature can range from about 2050° F. to about 2350° F. with the sintering time ranging from about thirty minutes to about two hours conducted by vacuum sintering or Pusher furnace sintering techniques known in this art. An inert atmosphere may be utilized and the atmosphere ratio of $N_2/H_2$ gas can range from 100% $N_2$ to 100% $H_2$ gas. The present invention can be used in either the "as-sintered" condition or in a heat treated condition. The heat treatment methods for powder metallurgy are well known in the art. The powder metal component has an apparent hardness ranging from about 45-95 HRB, and a preferred minimum hardness of about 50 HRB.

In forming a valve guide, the material may be coined from the ends in a manner known in the art. This serves two purposes: straightening of the inner diameter (ID) of the bore to maintain the concentricity between the bore ID and the stem OD, and additional densification of the wear surface to further enhance the anti-scuffing properties. Coining of the ends is optional and may be conducted at a minimum coining pressure of approximately 30 TSI. A preferred coining pressure is approximately 50 TSI. An alternative to the coining process is machining the lead chamfers at the ends of the component instead of coining the ends.

The component may be oil impregnated with a minimum impregnation time of about ten minutes, and minimum oil content of approximately 0.75 weight percent of a high temperature oil known in the art. Preferably, the impregnating time is approximately twenty minutes and the oil content is about 1.0 weight percent. The oil fills in the pores in the powder metal component and serves as reservoirs to provide continuous lubrication during application and to improve machineability during manufacturing.

In making the valve guide, the powder metal component is machined with outer diameter (O.D.) grinding to an OD tolerance of between about ten to about twenty microns with an OD tolerance of about 16 microns being preferred.

The powder metal component made with the previously described process has the following chemical composition on a weight percent basis:

about 0.1% to about 2.0% C (carbon);
about 8.0% to about 18.0% Cr (chromium);
about 1.0% to about 15.0% Mo (molybdenum);
about 0.1% to about 3.5% S (sulfur);
about 0.1% to about 2.0% Si (silicon);
upto about 5.0% maximum (max) other elements (including but not limited to about 0% to about 0.6% W, about 0% to about 2.0% Ni, about 0% to 0.5% V and about 0% to about 1.9% Cu); and
the balance being substantially Fe (iron).

The powder metal valve guide according to the first embodiment of the present invention has a preferred chemical composition on a weight percent basis as follows:

about 0.5% C;
about 16.6% Cr;
about 4.0% Mo;
about 1.0% S;
about 0.2% Ni;
about 1.0% Si;
and the balance being substantially iron.

A second cobalt based embodiment according to the present invention employs a powder metal blend comprising a hard phase intermetallic material, graphite, a solid lubricant, a fugitive lubricant, and a stainless steel material.

The cobalt based embodiment is similar to the first embodiment except that the hard phase intermetallic material comprises a Cold 40 cobalt based material, or a Tribaloy 400 or T-400 material, commercially available from North American Hoganas. The Cold 40 material comprises on a weight percent basis from about 5% to about 50% of the powder metal blend, and is preferably about 20% of the powder metal blend.

The solid lubricant in the second embodiment of the present invention comprises a similar composition and range as the first embodiment, but preferably comprises about 3.50% of the powder metal blend.

The preferred powder metal blend in accordance with the second embodiment comprises on a weight percent basis approximately 77% 434 ss material, approximately 20% T-400, approximately 0.5% graphite, approximately 3.5% molybdenum disulfide, and approximately 0.6% Kenolube.

The powder metal blend according to the second embodiment of the present invention is processed in a manner identical to that previously described herein with respect to the first embodiment.

The chemical composition of the finished powder metal component for the second embodiment is as follows on a weight percent basis:

about 0.1 to about 2.0% carbon; about 8.0% to about 18.0% chromium; about 1.0% to about 15.0% molybdenum; about 0.1 to about 3.5% sulfur; about 0.1 to about 2.0% silicon; about 8.0% to about 16.0% cobalt; upto about 5.0% maximum other elements; and the balance being substantially iron.

The preferred embodiment of the cobalt based material according to the present invention comprises a chemical composition on a weight percent basis of about 0.5% C; about 16.0% Cr; about 9.7% Mo; about 1.9% S; about 0.4% Ni; about 1.3% Si; about 11.8% Co; and the balance being substantially Fe. This embodiment has a preferred minimum density of about 6.2 g/cm3 and a minimum apparent hardness value of about 50 HRB.

Figure 3:
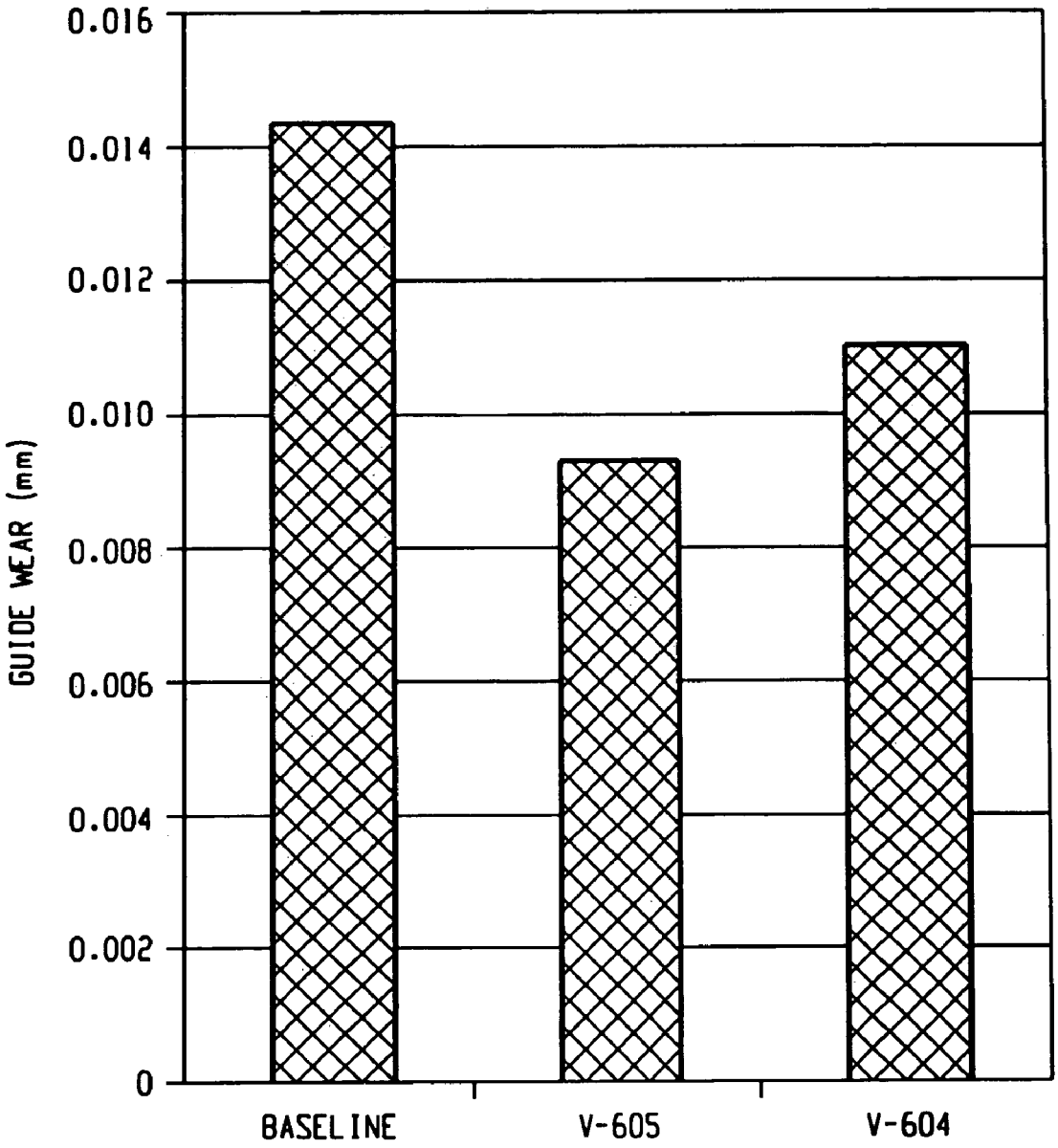
FIG. 3 is a graph of average valve guide inner diameter wear for both embodiments of the present invention compared with a baseline material.

Turning now to FIG. 3, there is shown a graph of average valve guide wear in millimeters (mm) for three different valve guide materials. The EGR valve guide wear test employs an actual EGR unit to replicate the reciprocating valve movement. The valve actuates in a controlled manner by an engine control unit (ECU) at a frequency of 1 Hz which is a typical frequency in a real application. The elevated temperature on the face of the valve and the valve—valve guide interface at the hot end of the guide is achieved by means of a flame from a gas burner impinging on the face of the valve. The valve face is maintained at a temperature of approximately 1350° F. The temperatures are monitored with thermocouples attached at different locations on the valve and valve guide. In order to accelerate wear, a side load of about two pounds is applied to the valve stem by means of suspended weights attached to the valve stem with a high temperature resistant wire. The test is terminated after about twenty hours. The valve guide is disassembled from the unit and the wear is measured at the hot end of the valve guide and compared with the valve guides initial inner diameter and surface finish. The stem material for all tests was a chrome plated Inconel 751 material. The baseline material for the valve guide is an EMS 543 material, which is a conventional valve guide material employed in the art, that has typically the following chemical composition on a weight percent basis: about 0.6-1.0% C; 0.5-1.0% Mn; 3.5-5.5% Cu; 0.2-0.6% Mg; 0.15-0.35% S; 0.05% P(max); other elements 4.0% max; and the balance being Fe. The baseline material has a minimum density of 6.5 g/cm3 and an apparent hardness of from 70-85 HRB.

The V-605 material which is the material according to the first embodiment of the present invention has the least amount of wear. The V-604 material which is the material according to the second embodiment of the present invention also performed very well. Both embodiments of the present invention exhibited significantly less wear than the baseline material EMS 543.

Figure 4:
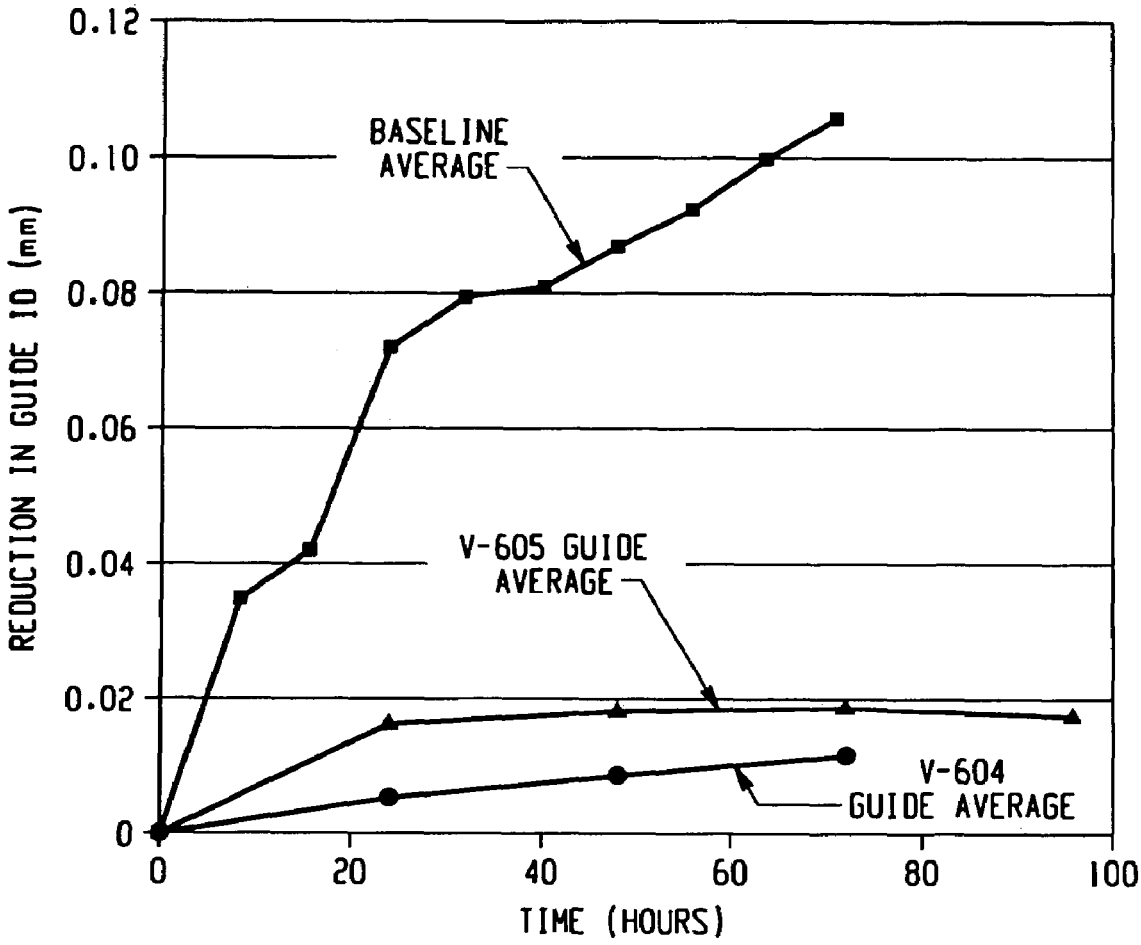
FIG. 4 is a graph illustrating the reduction in valve guide inner diameter over time for furnace exposure test for the same materials of FIG. 3.

Referring next to FIG. 4, there is shown a graph of these same three materials in a furnace exposure test. The furnace exposure test was conducted to measure inner diameter changes due to exposure at a high temperature of approximately 1400° F. for about twenty-four hours in an air atmosphere. The valve guide samples had their inner diameters measured at three locations before and after the test. All of the samples were coated with Avion Carburization stop-off after their initial measurements, but prior to heating. The coating was removed after heating, but prior to taking the post-heating measurements. Again, both embodiments of the present invention exhibited significantly less reduction in valve guide ID than the baseline material EMS 543.

Advantageously, as mentioned previously, powder metal components made in accordance with the present invention may be used in the as-sintered condition and/or heat treated condition. Further, these powder metal components may be subjected to other treatments including, but not limited to, nitriding, carbonizing, carbon nitriding, or steam treatment. The resultant product may be copper infiltrated to improve thermal conductivity if desired.

We claim:

1. A powder metal component formed from a mixture which includes a hard phase intermetallic material, the powder metal component having a chemical composition on a weight percent basis, consisting of:

about 0.1 to about 2.0% C;
about 8.0 to about 18.0% Cr;
about 1.0 to about 15.0% Mo;
about 0.1 to about 3.5% S;
about 0.1 to about 2.0% Si
upto about 5.0% other elements, wherein said other elements comprise upto about 0.6% W, upto about 2.0% Ni, upto about 0.5% V, and upto about 1.9% Cu; and
the balance being substantially iron, said powder metal component having a microstructure which includes an intermetallic Laves phase.

2. A powder metal component as recited in claim 1 wherein said powder metal component comprises a valve guide.

3. A powder metal component as recited in claim 1, wherein said powder metal component is compacted to a density ranging from about 6.2 g/cm$^3$ to about 7.2 g/cm$^3$.

4. A powder metal component as recited in claim 1, wherein said powder metal component comprises a minimum hardness value of about HRB 45.

5. A powder metal component formed from a mixture which includes a hard phase intermetallic material, the powder metal component having a chemical composition on a weight percent basis, comprising:

about 0.5% C;
about 16.6% Cr;
about 4.0% Mo;
about 1.0% S;
about 0.2% Ni;
about 1.0% Si;
upto about 5.0% other elements, wherein said other elements comprise upto about 0.6% W, upto about 0.5% V, and upto about 1.9% Cu; and
the balance being substantially iron, said powder metal component having a microstructure which includes an intermetallic Laves phase.

6. A powder metal component as recited in claim 4, wherein said hardness value ranges from about 45 to about 95 HRB.

7. A powder metal component as recited in claim 5, wherein said powder metal component is compacted to a density ranging from about 6.2g/cm$^3$ to about 7.2g/cm$^3$.

8. A powder metal component as recited in claim 7, wherein said powder metal component has a hardness value ranging from 45 HRB to about 95 HRB.

9. A powder metal component having a chemical composition on a weight percent basis, comprising:

about 0.5% C;
about 16.0% Cr;
about 9.7% Mo;
about 1.9% S;
about 0.4% Ni;
about 1.3% Si;
about 11.8% Co;
upto about 5.0% max other elements, wherein said other elements comprise upto about 0.6% W, upto about 0.5% V, and upto about 1.9% Cu; and
the balance being substantially iron.

10. A powder metal component as recited in claim 9, wherein said powder metal component is copper infiltrated.

11. A powder metal component as recited in claim 9, wherein said powder metal component is oil impregnated.

12. A powder metal component as recited in claim 2, wherein said valve guide comprises an EGR valve guide.

13. A powder metal component as recited in claim 2, wherein said valve guide comprises a valve guide for turbo applications.

14. A powder metal component as recited in claim 2, wherein said valve guide is copper infiltrated.

15. A powder metal component as recited in claim 2, wherein said valve guide is oil impregnated.

16. A powder metal component as recited in claim 9, wherein said powder metal component comprises a valve guide.

17. A powder metal component as recited in claim 16, wherein said valve guide comprises an EGR valve guide.

18. A powder metal component as recited in claim 16, wherein said valve guide comprises a valve guide for turbo applications.

* * * * *